US006334439B1

(12) United States Patent
Specht et al.

(10) Patent No.: US 6,334,439 B1
(45) Date of Patent: Jan. 1, 2002

(54) TUBULAR HEAT EXCHANGER FOR INFRARED HEATER

(75) Inventors: Werner O. Specht, Sharpsville; Philip E. Lengauer, Clarks Mills, both of PA (US)

(73) Assignee: Thomas & Betts, International, Inc., Sparks, NV (US)

( * ) Notice: Subject to any disclaimer, the term of this patent is extended or adjusted under 35 U.S.C. 154(b) by 0 days.

(21) Appl. No.: 09/532,333

(22) Filed: Mar. 21, 2000

Related U.S. Application Data

(60) Provisional application No. 60/138,908, filed on Jun. 11, 1999.

(51) Int. Cl.[7] ..... F24C 3/04

(52) U.S. Cl. ..... 126/91 A; 126/92 B; 431/154; 165/77; 285/19; 285/283

(58) Field of Search ..... 126/91 A, 91 R, 126/92 B, 271.2 R; 251/149, 142, 149.8; 165/77, 76; 285/19, 18, 124.1, 124.2, 124.3, 124.4, 283, 184, FOR 118; 277/345, 370; 431/154

(56) References Cited

U.S. PATENT DOCUMENTS

| | | | | | |
|---|---|---|---|---|---|
| 1,408,631 | A | | 3/1922 | Para | 165/77 |
| 1,671,938 | A | | 5/1928 | Sinclair | 165/77 |
| 1,754,857 | A | | 4/1930 | Harrison | 165/77 |
| 1,987,372 | A | | 1/1935 | Schellhammer | 126/307 R |
| 2,424,792 | A | | 7/1947 | Blum | 165/77 |
| 2,590,866 | A | | 4/1952 | Jost et al. | 165/77 |
| 2,598,474 | A | * | 5/1952 | Weaver | 126/91 A |
| 2,791,997 | A | * | 5/1957 | Monkowski | 126/91 A |
| 2,960,983 | A | * | 11/1960 | Goss | 126/91 A |
| 3,198,492 | A | | 8/1965 | Schneider | 165/81 |
| 3,352,573 | A | * | 11/1967 | Canning | 285/283 |
| 3,527,290 | A | * | 9/1970 | Lossing | 165/77 |
| 3,861,419 | A | * | 1/1975 | Johnson | 285/184 |
| 3,960,393 | A | * | 6/1976 | Hosokawa et al. | 285/124.4 |
| 3,974,022 | A | | 8/1976 | Lauro | 165/77 |
| 3,990,262 | A | | 11/1976 | Griffin | 165/77 |
| 4,319,125 | A | * | 3/1982 | Prince | 126/92 B |
| 4,546,820 | A | | 10/1985 | Whipple | 165/77 |
| 5,174,366 | A | | 12/1992 | Nagakura et al. | 165/77 |
| 5,342,097 | A | * | 8/1994 | Hanson | 285/124.1 |
| 5,460,415 | A | * | 10/1995 | Lengauer et al. | 126/92 B |
| 5,492,167 | A | | 2/1996 | Glesmann | 165/77 |
| 5,626,125 | A | * | 5/1997 | Eaves | 126/91 A |
| 5,735,085 | A | * | 4/1998 | Denooy | 285/283 |

FOREIGN PATENT DOCUMENTS

| | | | |
|---|---|---|---|
| JP | 61-231351 A | * | 10/1986 |
| WO | WO-95/09285 A1 | * | 4/1995 |

* cited by examiner

*Primary Examiner*—Ira S. Lazarus
*Assistant Examiner*—Josiah C. Cocks
(74) *Attorney, Agent, or Firm*—Hoffmann & Baron, LLP

(57) ABSTRACT

A tubular heat exchanger for an infrared heater which facilitates the packaging and transportation of such heater. The tubular heat exchanger is formed as a plurality of discrete heat transfer subsections which are typically separately assembled, and then brought together to form the heat exchanger. The heat transfer subsections may be coupled together via a hinge which allows relative rotation between the two subsections, or via conventional hardware. The individual heat transfer pipes of each heat transfer subsection are connected on at least one end to a header plate, which allows the subsequent assembly of the heat transfer subsections.

27 Claims, 11 Drawing Sheets

TUBULAR HEAT EXCHANGER FOR INFRARED HEATER

This application claims the benefit of U.S. Provisional Application No. 60/138,908, filed Jun. 11, 1999.

BACKGROUND OF THE INVENTION

The present invention relates to a radiant heater and, more particularly, to an infrared radiant heater including a heat exchanger which facilitates the packaging and transportation of the heater.

Low-intensity infrared heaters utilizing tubular heat exchangers are well known in the art. These heaters typically incorporate a burner unit at one end, which burns an air/fuel mixture to provide hot combustion product gases. These gases are then passed through a plurality of heat transfer pipes, referred to collectively as the heat exchanger, and are then exhausted via a fan or other flow-inducing device. The surrounding space is heated via radiant heat transfer from the heated pipes.

Prior art low-intensity infrared heaters utilize heat transfer pipes which typically range in length from 12' to 20', but may also utilize pipes having even greater lengths. Accordingly, these units require oversized packaging crates, i.e., 12 to 20' crates or larger. These oversized crates make shipping and handling of the heaters quite difficult, leading to increased shipping costs and greater likelihood of damage to the packaged units. Alternatively, prior art heaters utilize individual sections of pipe which must be coupled together using clamping collars and the like.

There is therefore a need in the art for a heater (utilizing a tubular heat exchanger) which readily "breaks down" for shipping (thus allowing the use of significantly smaller packaging crates which saves shipping costs and reduces the likelihood of damages), but which is readily unpackaged and installed without requiring any significant assembly at the installation site.

SUMMARY OF THE INVENTION

The present invention, which addresses the needs of the prior art, relates to a heater. The heater includes a burner for burning a combustible gas to provide hot combustion product gases. The heater further includes first and second heat transfer pipes each having first and second ends. The first end of the first pipe communicates with the burner for receipt of the gases. The heater further includes first and second header plates configured for securement to one another. Each of the header plates includes an aperture. The second end of the first pipe is coupled to the first header plate such that the first pipe communicates with the aperture extending therethrough. The first end of the second pipe is coupled to the second header plate such that the second pipe communicates with the aperture extending therethrough whereby the pipes fluidly communicate with each other when the header plates are secured together thus allowing the gases to flow from the first pipe to the second pipe. Finally, the first and second header plates of the heater are rotatably connected to one another.

In another embodiment of the present invention, the heater includes a burner box having a burner for burning a combustable gas to provide hot combustion product gases. The heater further includes a first outflow pipe and a first return pipe. Each of the first pipes has first and second ends. The first end of the first outflow pipe communicates with the burner box for receipt of the product gases and the first end of the first return pipe communicates with the burner box for return of the product gases. The first pipes extend from the burner box in a substantially common direction. The heater further includes a first header plate. The first header plate includes a first outflow pipe aperture and a first return pipe aperture. The first aperture is sized and positioned to communicate with the second ends of the first pipes. The second end of the first outflow pipe is coupled to the first header plate such that the first outflow pipe communicates with the first outflow pipe aperture. The second end of the first return pipe is coupled to the first header plate such that the first return pipe communicates with the first return pipe aperture. The heater further includes a second outflow pipe and a second return pipe. Each of the second pipes has first and second ends. The heater further includes a second header plate. The second header plate includes a second outflow pipe aperture and a second return pipe aperture. The second apertures are sized and positioned to communicate with the first ends of the second pipes. The first end of the second outflow pipe is coupled to the second header plate such that the second outflow pipe communicates with the second outflow pipe aperture. The first end of the second return pipe is coupled to the second header plate such that the second return pipe communicates with the second return pipe aperture whereby the second pipes extend from the second header plate in a substantially common direction. The heater further includes a fluid passage connecting the second end of the second outflow pipe to the second end of the second return pipe. Finally, the first header plate is configured to be coupled to the second header plate whereupon the first outflow pipe is brought into fluid communication with the second outflow pipe and the first return pipe is brought into fluid communication with the second return pipe.

Finally, the present invention relates to a multiple pipe assembly. The assembly includes a first set of pipes. Each of the pipes in the first set has a first end and a second end. The assembly further includes a first header plate. The first header plate includes a plurality of apertures. The second end of each of the pipes in the first set is coupled to the first header plate such that each of the pipes in the first set communicates with one of the apertures in the first header plate. The assembly further includes a second set of pipes. Each of the pipes in the second set has a first end and a second end. The assembly further includes a second header plate. The second header plate includes a plurality of apertures. The first end of each of the pipes in the second set is coupled to the second header plate such that each of the pipes in the second set communicates with one of the apertures in the second header plate. Finally, the header plates are configured to be coupled to one another whereby the pipes of the first set are brought into fluid communication with the pipes of the second set.

As a result, the present invention provides a heater utilizing a tubular heat exchanger which readily "breaks down" for shipping thus allowing use of significantly smaller packaging crates which saves shipping costs and reduces the likelihood of damages, but which is readily unpackaged and installed without requiring any significant assembly at the installation site. The present invention also provides a multiple pipe assembly for use in applications wherein it is desired to combine separate tubular subsections to provide a set of pipes having an overall longer length.

DETAILED DESCRIPTION OF THE INVENTION

Figure 1:
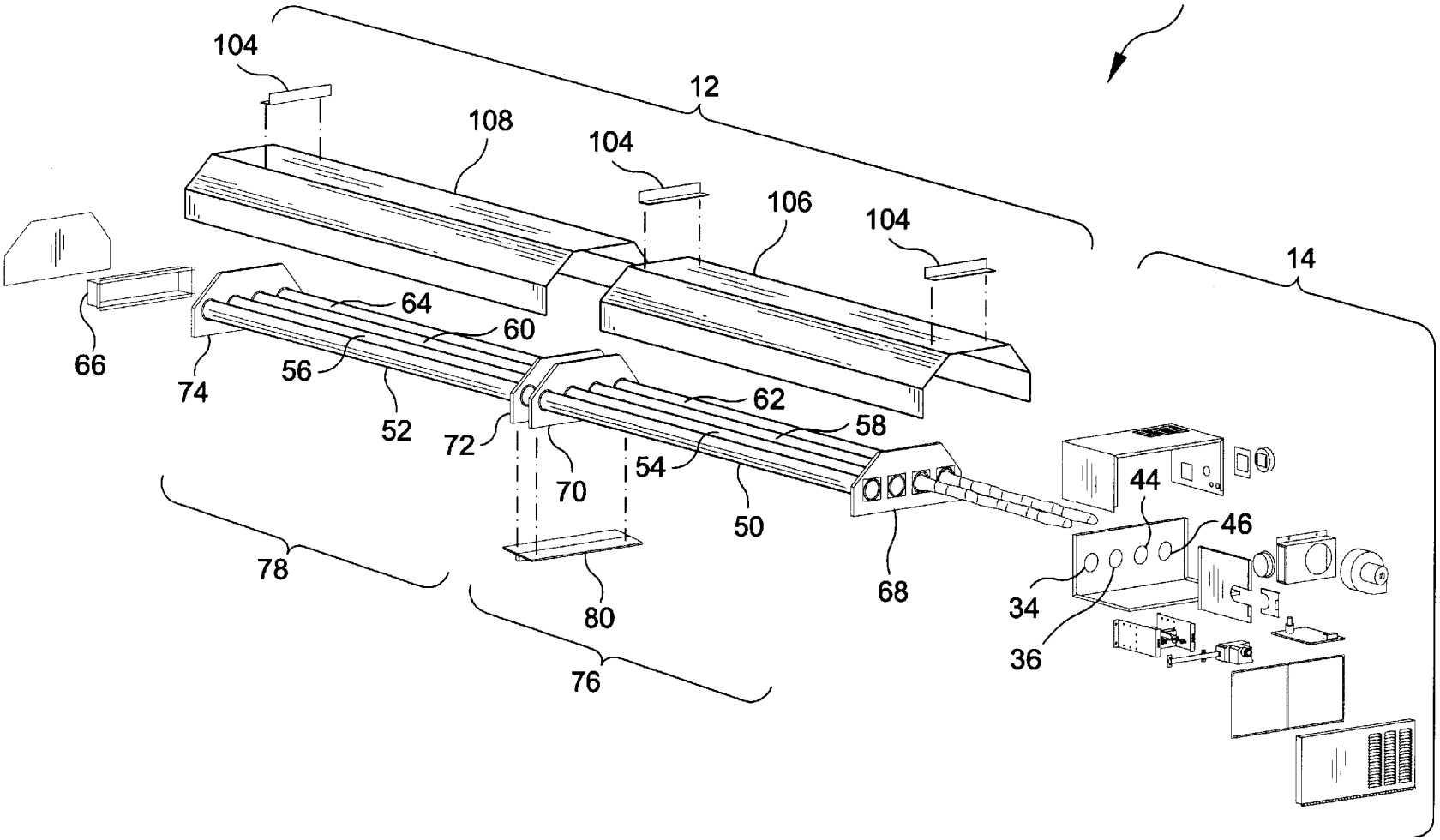
FIG. 1 is an exploded perspective view of the hinged tubular heat exchanger of the present invention in its open installation position.
Figure 2:
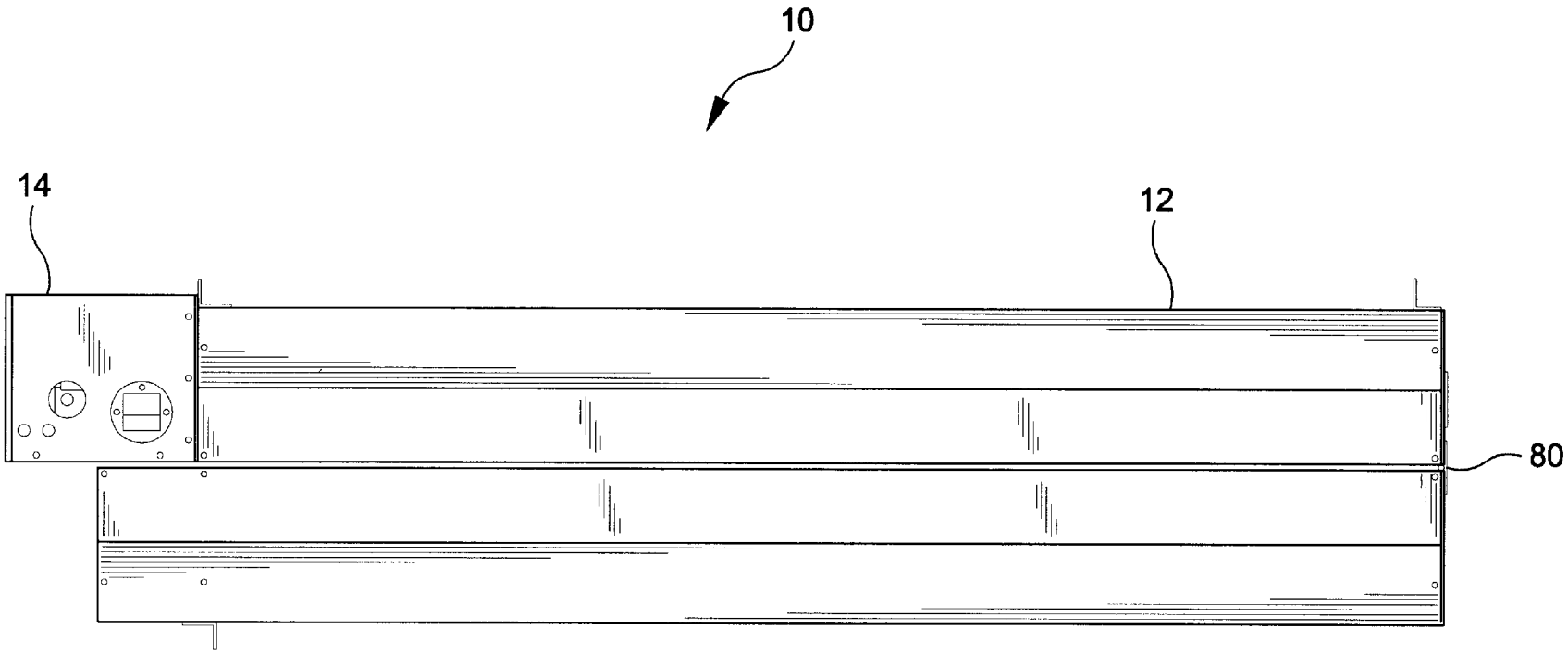
FIG. 2 is an elevational view showing the tubular heat exchanger of FIG. 1 in its closed packaging/shipping position.

Low-intensity infrared heater 10, including a hinged tubular heat exchanger 12, is shown in FIG. 1. Heater 10 is shown in its open installation position, and spans a length of approximately 14½ feet. It has been discovered herein that the hinged tubular heat exchanger allows the overall length of the heater to be reduced for shipping/handling purposes without substantially increasing the installation time and/or complexity. Heater 10 is shown in its closed packaging/shipping position in FIG. 2. In this closed position, heater 10 has a length of approximately 7½ feet. Accordingly, the packaging/shipping length is approximately one-half the open installation length. Of course, the dimensions described with respect to heater 10 are merely exemplary, and the heat exchanger associated therewith could be produced having any desirable length.

It is contemplated herein that, if necessary, heat exchanger 12 may include more than one hinged joint, which would allow further reduction in the packaging/shipping length. It is also contemplated that heat exchanger 12 can simply include a plurality of discreet subsections which are secured together without the use of a hinge. It is further contemplated that the disclosed heat exchanger may be incorporated into heater units (other than low-intensity infrared heaters) utilizing relatively long sections of piping. Finally, it is contemplated that the multiple pipe assemblies disclosed herein may be used in applications unrelated to infrared heaters, i.e., applications which require long lengths of multiple pipes, but which would benefit from a design wherein separate tubular subsections are connected together to provide a set of pipes having an overall longer length.

Figure 3:
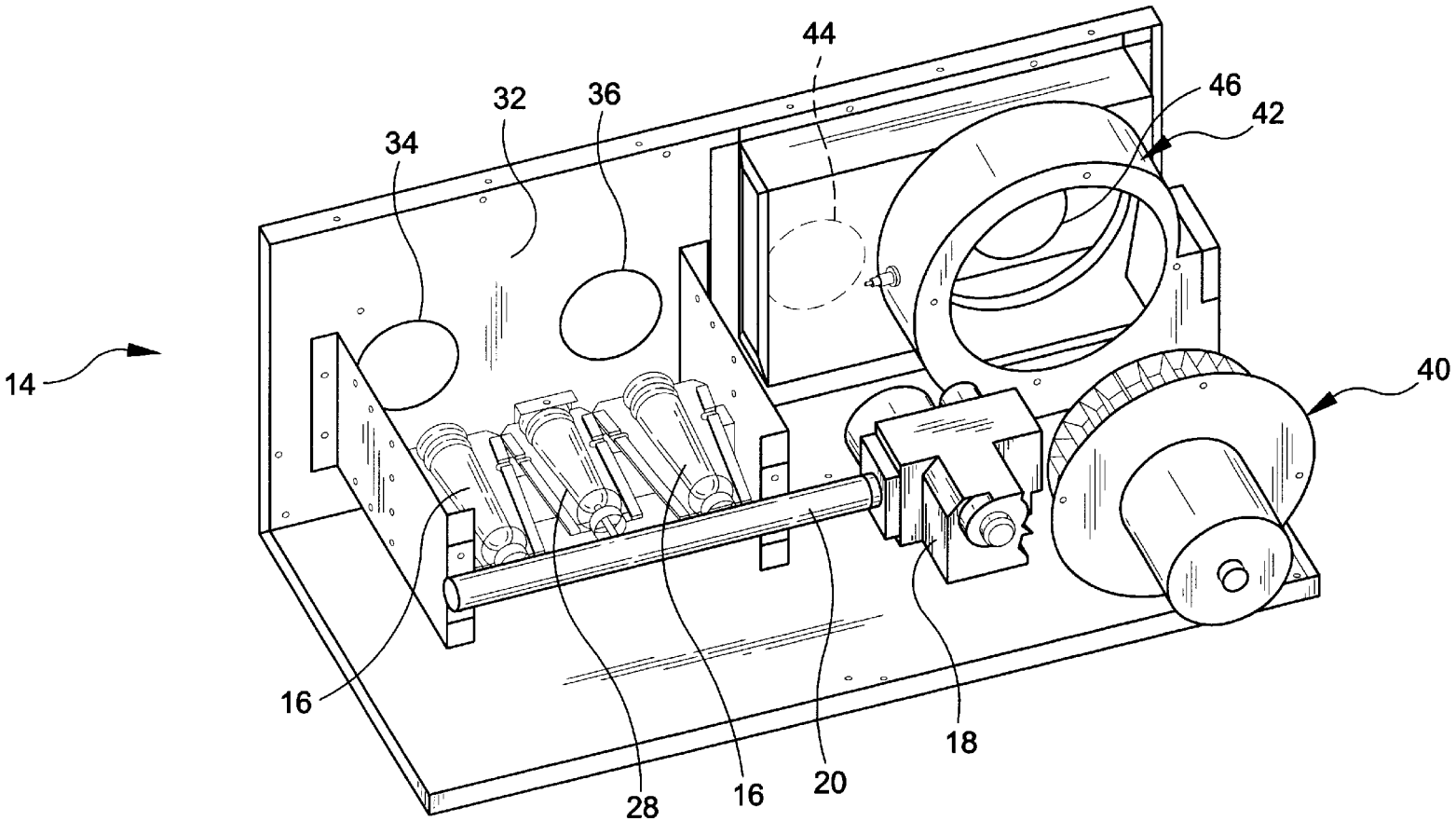
FIG. 3 is a perspective view of the partially assembled burner box of the present invention.
Figure 4:
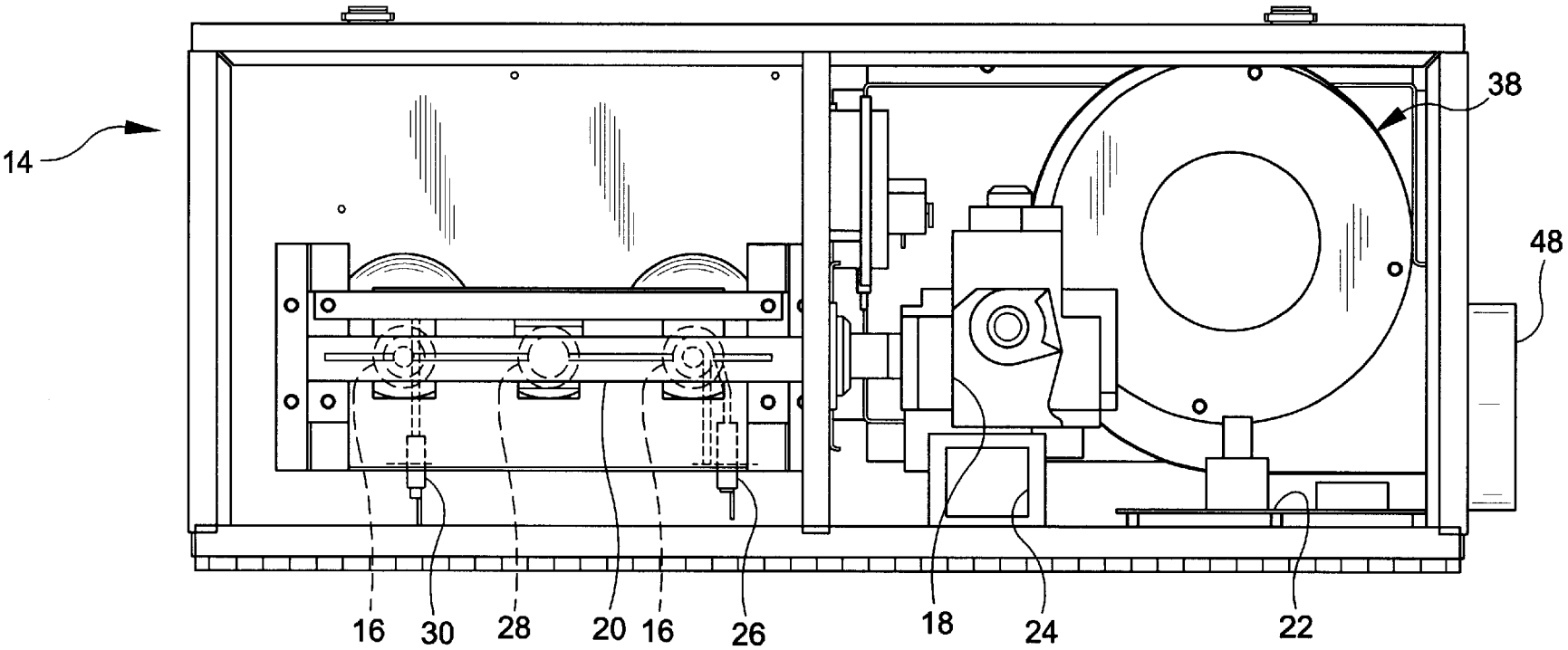
FIG. 4 is an elevational view of the fully assembled burner box of the present invention.

Heater 10 includes a burner box 14. As shown in more detail in FIGS. 3–4, burner box 14 houses a pair of burners 16 for burning a combustible gas to provide hot combustion product gases. The combustible gas is supplied to burners 16 through a gas valve 18 and a manifold 20. In this regard, burner box 14 further includes an ignition control board 22, a transformer 24, a spark electrode 26, a carryover burner 28 and a flame sensor 30. The forward wall of the burner box, i.e., wall 32, includes apertures 34 and 36 through which the hot combustion product gases are directed. Burner box 14 also houses a venting unit 38 which includes a fan assembly 40 and a housing assembly 42. The venting unit is designed to draw gas through apertures 44 and 46 formed in wall 32 and discharge such gas through exhaust port 48.

Heater 10 includes a plurality of heat transfer pipes, namely outflow pipes 50, 52, 54 and 56 and return pipes 58, 60, 62 and 64. As shown in FIG. 1, outflow pipes 50 and 54 are axially aligned and in fluid communication with outflow pipes 52 and 56, respectively, and direct the hot combustion product gases away from burner box 14. In this regard, the upstream ends of outflow pipes 50 and 54 communicate with apertures 34 and 36 respectively, whereby outflow pipes 50 and 54 receive the hot combustion product gases produced by burners 16. Return pipes 58 and 62 are axially aligned and in fluid communication with return pipes 60 and 64, respectively, and direct the hot combustion product gases back towards burner box 14. In this regard, the downstream ends of return pipes 58 and 62 communicate with apertures 44 and 46, respectively whereby the hot combustion product gases may be exhausted from the return pipes via venting unit 38 and discharged through exhaust port 48. A turning box 66, which functions as a manifold, fluidly couples the downstream ends of outflow pipes 52 and 56 to the upstream ends of return pipes 60 and 64. Alternating, two separate closed loops could be formed with the heat transfer pipes, e.g., pipes 50, 52, 58 and 60 could form one closed loop and pipes 54, 56, 62 and 64 could form a second closed loop.

Tubular heat exchanger 12 includes header plates 68, 70, 72 and 74. Outflow pipes 50 and 54 and return pipes 58 and 62 extend between header plates 68 and 70, thus providing a first heat transfer subsection 76, while outflow pipes 52 and 56 and return pipes 60 and 64 extend between header plates 72 and 74 thus providing a second heat transfer subsection 78. The subsections, which are typically separately assembled, are then brought together to form heat exchanger 12. Although heat exchanger 12 has been described herein as including two subsections, the heat exchanger could include any number of subsections.

Figure 5:
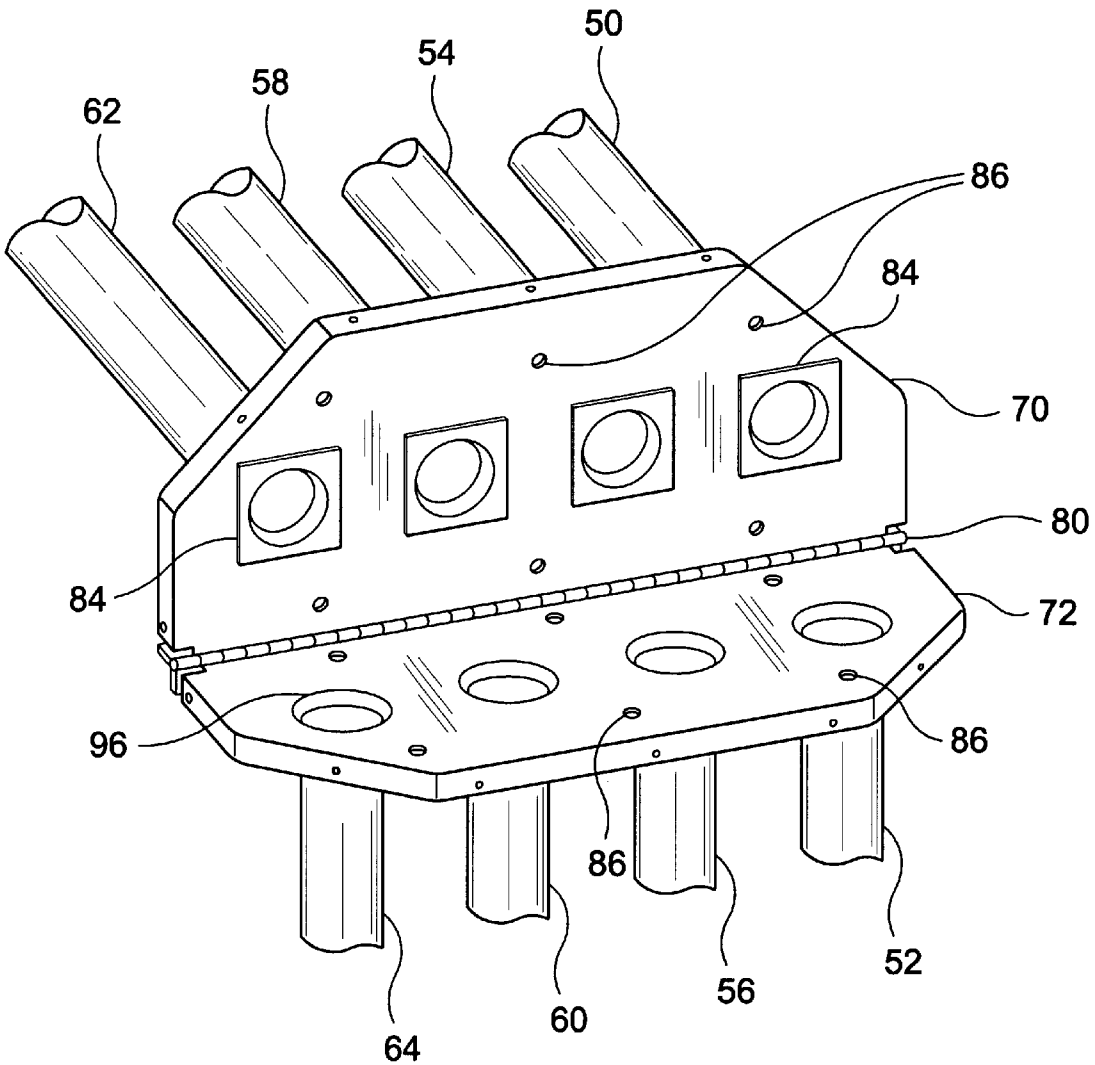
FIGS. 5–7 are enlarged details showing the hinged header plates and heat transfer pipes of the present invention.
Figure 6:
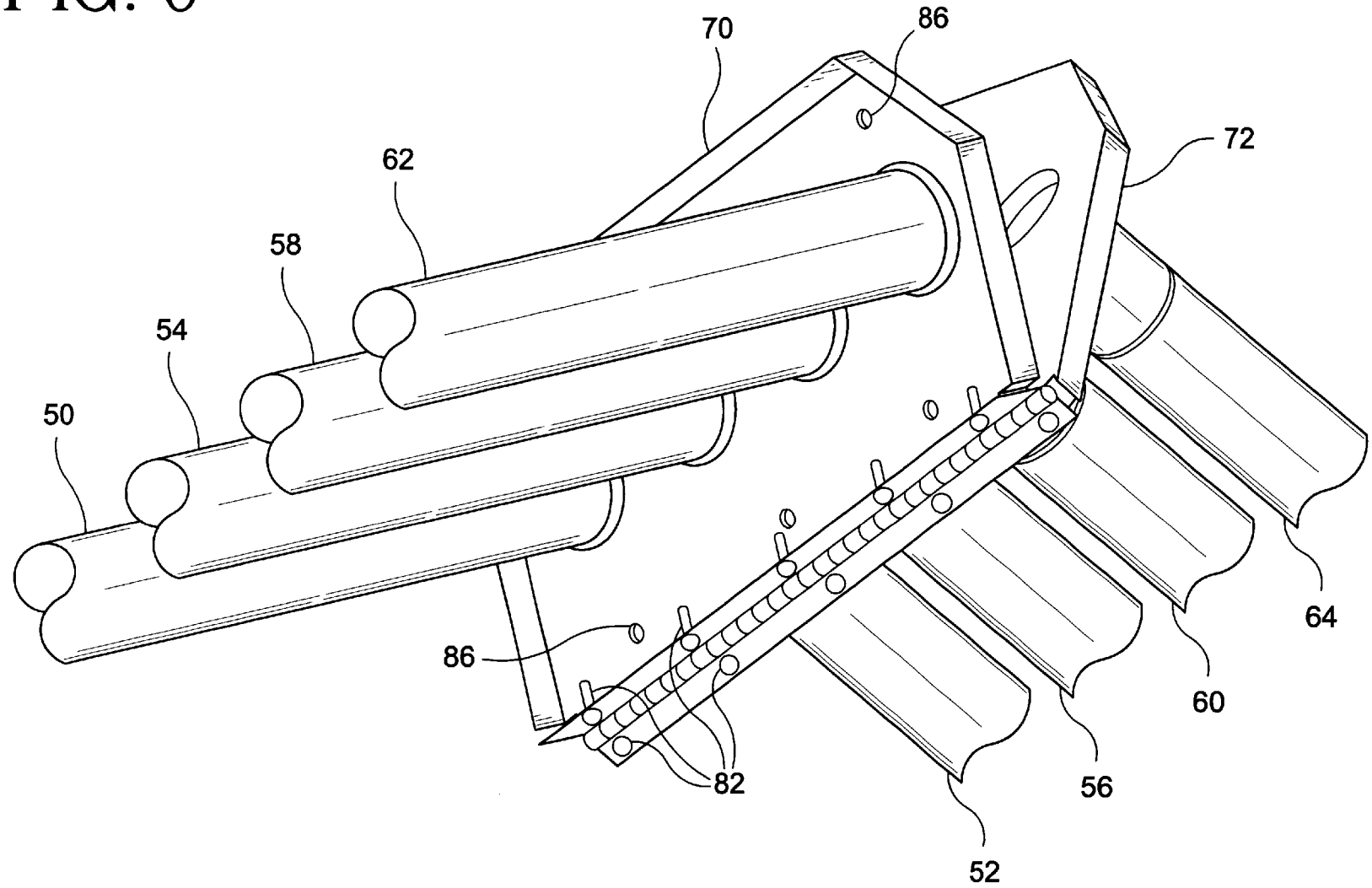

It has been discovered herein that the overall length of the heater can be significantly reduced for packaging/shipping if heat exchanger 12 includes at least one heat transfer subsection which may be reoriented for packaging/shipping. In one preferred embodiment, heat exchanger 12 includes a hinge 80 which rotatably connects header plate 70 to header plate 72 (see FIGS. 2 and 5). Preferably, hinge 80 is a piano hinge sized to extend substantially across the width of the header plates. The hinge is preferably a separate component formed independently of the header plate, and thereafter secured thereto via a plurality of screws 82 (see FIG. 6) or by other suitable means such as riveting, welding, etc. Alternatively, the hinge may be intregally formed with one or both header plates.

Of course, it is contemplated herein that the subsections of the heat exchanger may be aligned and secured together without the use of a hinge, that is, the subsections may be secured together simply by the securing hardware discussed hereinbelow, or by other mechanical fastening means. Also, the hinge discussed above may be designed to allow removal of the pin whereby the subsections of the heat exchanger are detachable. In these embodiments, the separate subsections can be individually packaged, thus allowing the use of even smaller packaging crates.

At least one gasket is preferably installed adjacent each header plate interface to ensure sealing between the connected components. More particularly, at least one gasket is installed at the burner box 14/header plate 68 interface, at the header plate 70/header plate 72 interface, and at the header plate 74/turning box 66 interface. Preferably, an individual gasket 84 is associated with each pair of co-axially arranged heat transfer pipes (see FIG. 5).

Installation of the hinged tubular heat exchanger simply requires the unpackaging of the heater from the packaging crate (not shown), and rotation of subsection 78 about hinge 80 until header plates 70 and 72 contact one another. In those embodiments without a hinge, the discreet subsections of the heat exchanger are brought together for securement. As shown, header plates 70 and 72 are configured for securement to one another. In this regard, header plates 70 and 72 include a plurality of holes 86 (see FIG. 5) sized to receive a plurality of bolts 88 (see FIG. 7) thus allowing the two header plates to be secured together once nuts 90 are installed on bolts 88. Once the heater is secured in its open position, the heat transfer pipes of subsection 76 are co-axially aligned with the heat transfer pipes of subsection 78. The installation of gaskets 84 ensures a sealing connection between the co-axially aligned pipes at the hinged joint.

Figure 7:
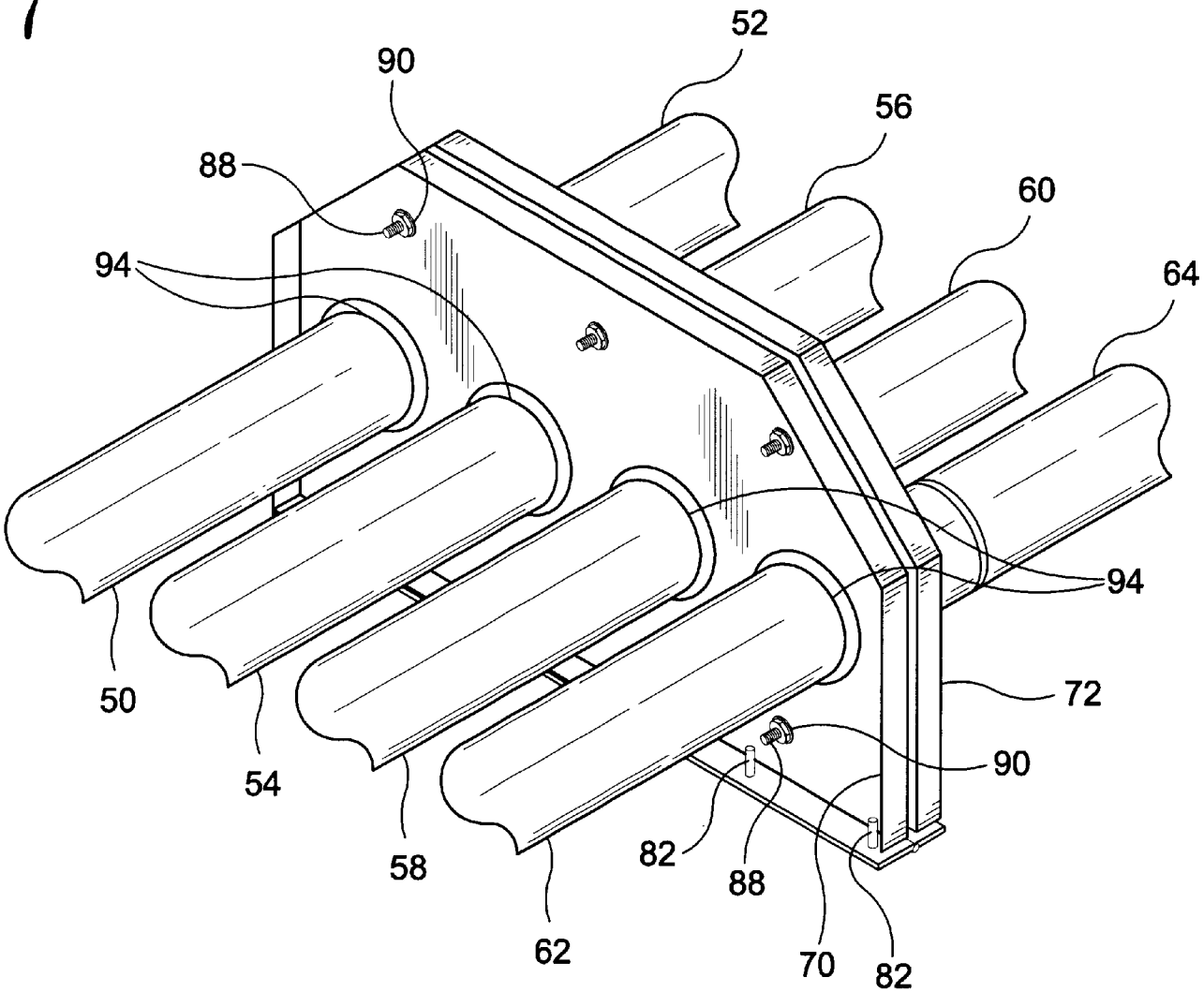
Figure 8:
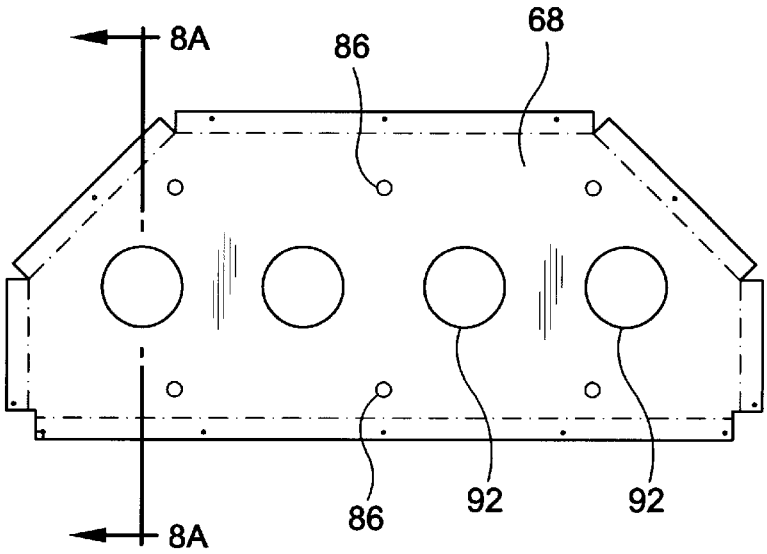
FIG. 8–9 are views of the header plate shown in FIGS. 5–7.
Figure 8A:
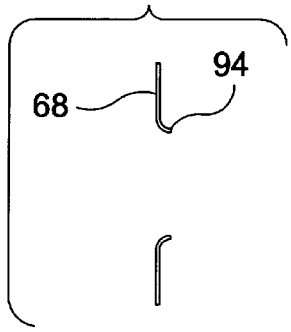
Figure 9:
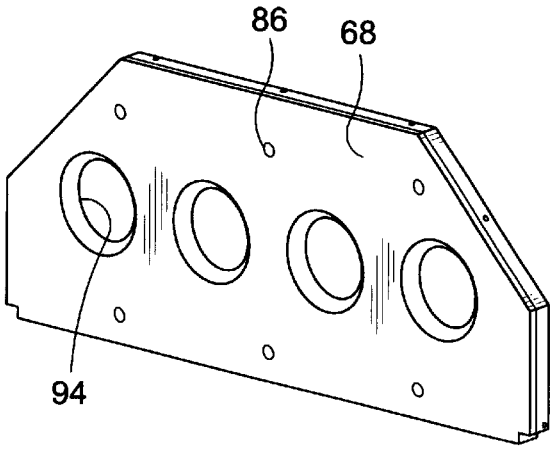
Figure 11:
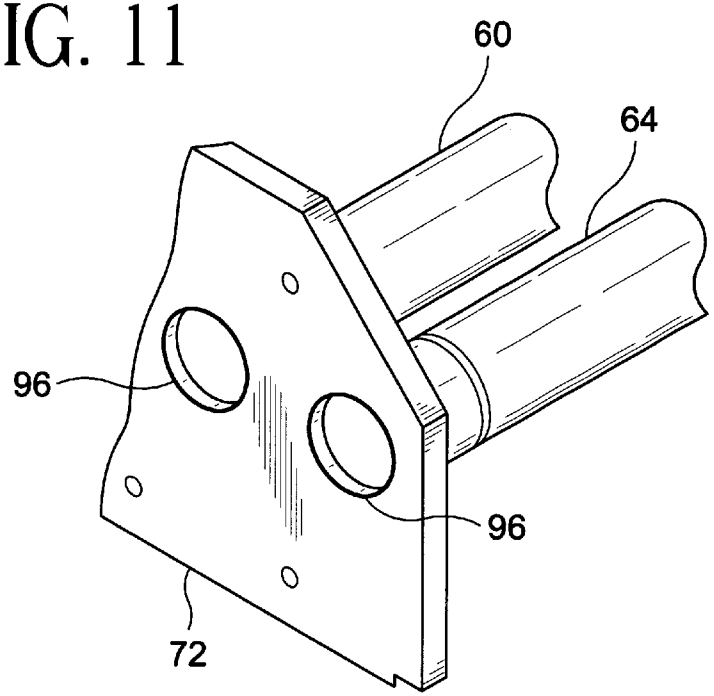
FIG. 11 is an enlarged detail showing the swaged flange at the end of a heat transfer pipe.
Figure 10:
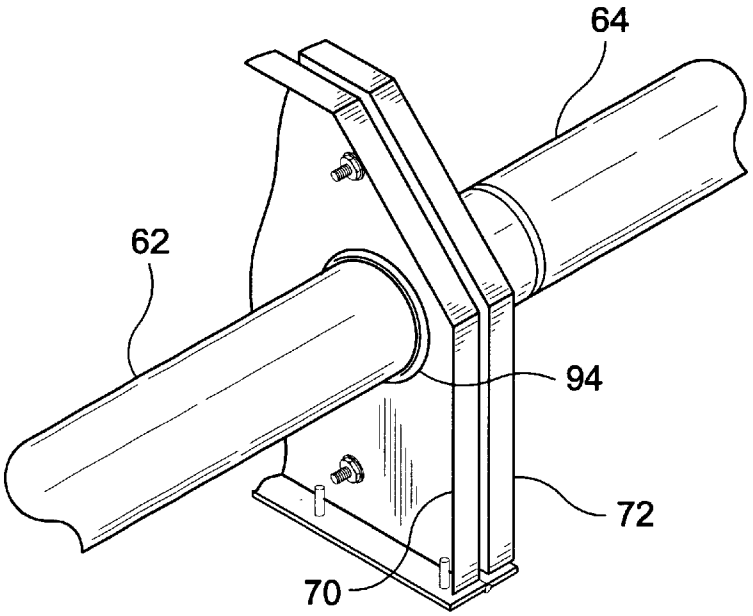
FIG. 10 is an enlarged detail showing a lip formed on the header plate sealing against an attached heat transfer pipe.
Figure 12:
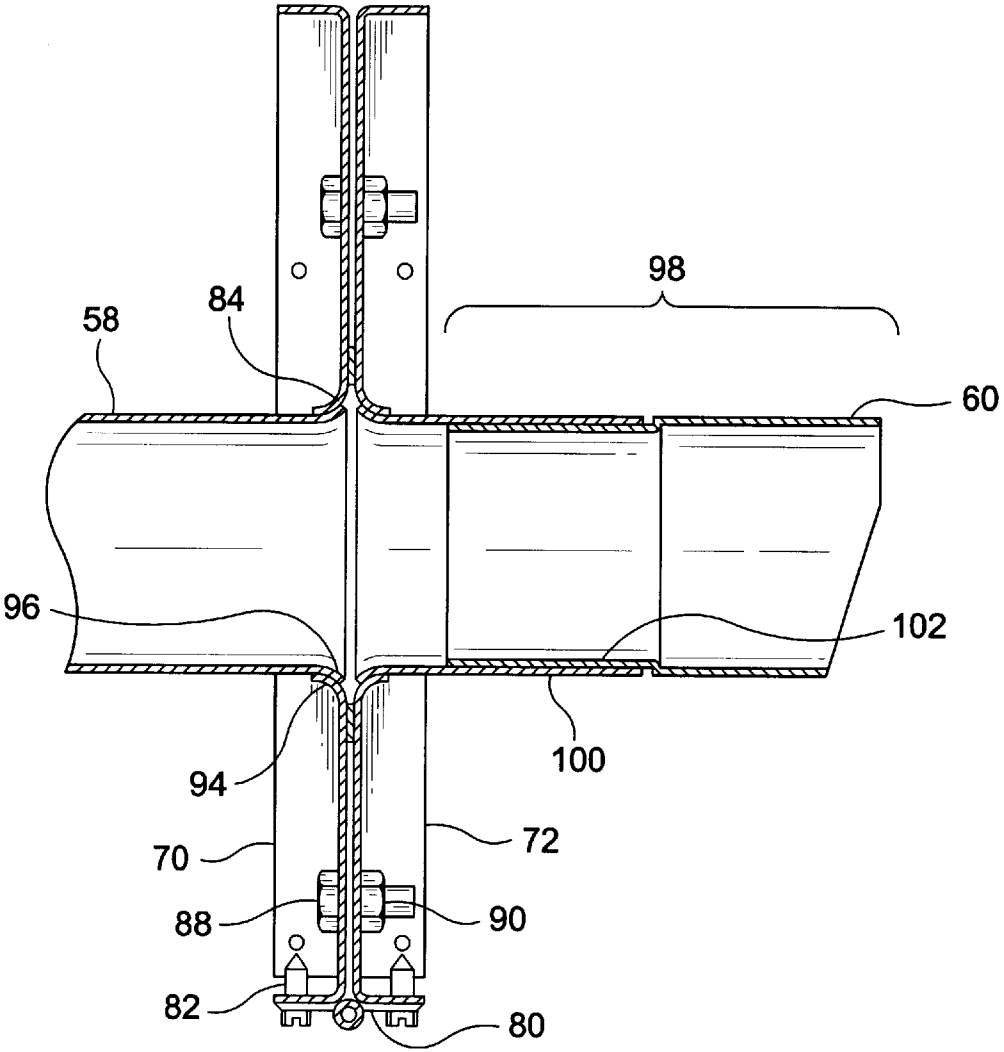
FIG. 12 is a cross-sectional view of the expansion joint of the present invention.

Header plate 68 is shown in detail in FIGS. 8–9. In this regard, header plates 68, 70, 72 and 74 are identical to one another. As shown, a plurality of flanges are formed about the periphery of header plate 68 via bending of a portion of the sheet material which forms the header plate. Apertures 92 are formed via a punch and extrude method which creates a lip 94 (as seen in FIG. 8*a*). Lip 94 is also is shown in FIG. 10. In this regard, the section of pipe which connects with the header plate passes through lip 94 (as shown in FIGS. 7, 10 and 12) and is thereafter subjected to a swaging operation which creates a flange 96 (see FIGS. 11 and 12) having a diameter greater than the diameter of aperture 92, thereby preventing the withdrawal of the pipe from the header plate. The swaging operation also expands the portion of the pipe adjacent lip 94 thereby creating a sealing relationship therebetween. As shown, each of the header plates is provided with a pair of outflow pipe apertures and a pair of return pipe apertures. The number of outflow and return pipes can vary, and the pipes do not have to be equal in quantity or size.

As will be recognized by those skilled in the art, the outflow pipes operate at a significantly higher temperature than the return pipes. As a result, the thermal expansion of the outflow pipes is greater than the thermal expansion of the return pipes. Inasmuch as both pipes are connected to a common header plate, operation of the heater unit could potentially cause disconnection of the return pipes from the header plates. The present invention contemplates this dissimilar expansion of the heat transfer pipes and incorporates an expansion joint into each section of return pipe. As shown in FIG. 12, an expansion joint 98 is shown on one of the return pipes. Expansion joint 98 includes a short segment of pipe 100 which is connected to one of the header plates. Pipe 100 has an inner diameter $D_1$. Return pipe 60 includes a terminating end 102 having a reduced outer diameter $D_2$, wherein $D_2$ is less that $D_1$ allowing terminating end 102 to slide within pipe 100. As a result, expansion joint 98 compensates for the greater thermal expansion experienced in the outflow pipes. Because the return pipes operate under a negative pressure, seals or gaskets are typically not required in the joint.

Inasmuch as heater 10 is typically suspended from an overhead structure, the heater preferably includes a plurality of hangers 104 fixed to an upper surface of the heater and configured for securement to conventional hanging hardware. The heat transfer pipes are preferably surrounded on three sides by reflectors 106 and 108, which in the preferred overhead installation direct the heat downward towards the area to be heated. Of course, the reflectors can assume other configurations than that shown in FIGS. 1–2 and, may in some applications, not be used at all with the heater. It will be appreciated that the novel design of the present heat exchanger allows such reflectors to be integrated with the individual subsections of the heat exchanger even during shipping of the unit, thus facilitating unpackaging and installation of the heater at the installation site.

Figure 13:
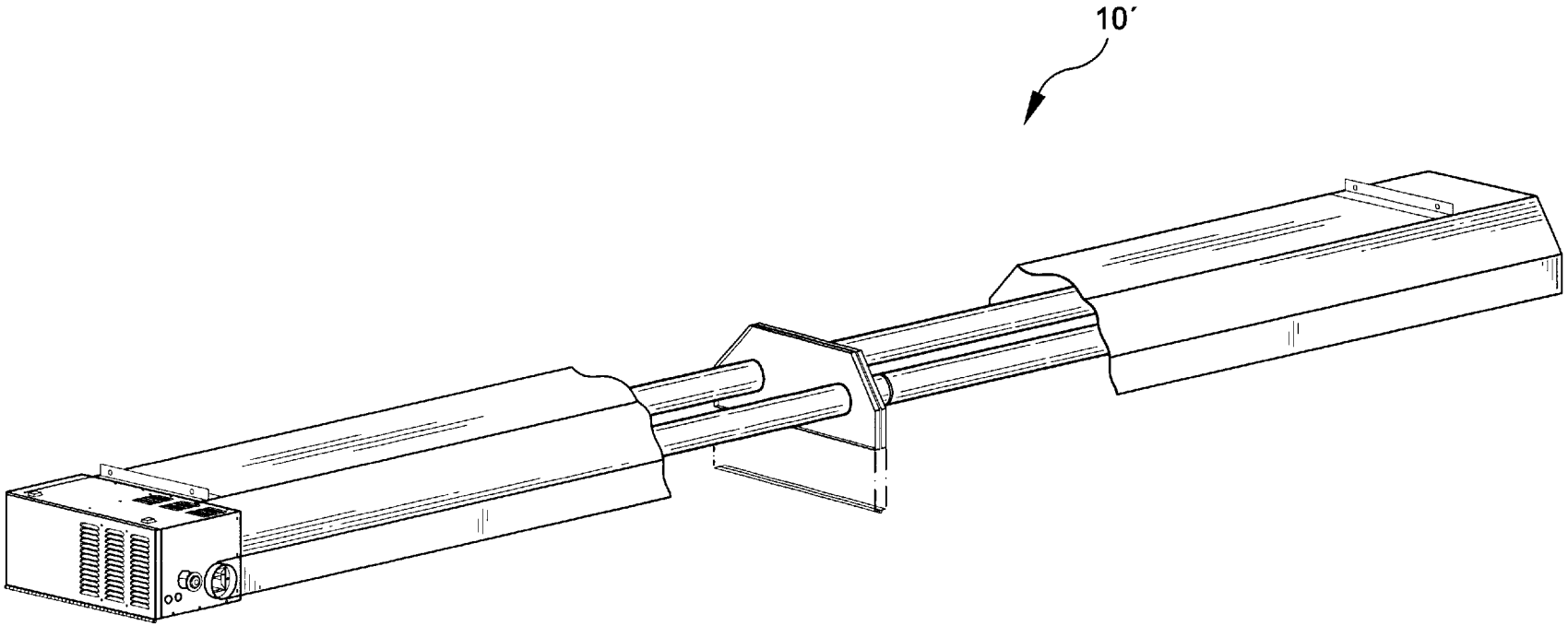
FIG. 13 is a perspective view of an alternative embodiment of the present invention.

An alternative embodiment of the present invention, i.e., heater 10', is shown in FIG. 13. Heater 10' is similar to heater 10, but includes a total of only four heat transfer pipes. It will be appreciated that the heat output of heater 10' will be less than the heat output of heater 10 (assuring other factors are constant). Heater 10' is therefore suitable for application where less heat output is required.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendment and/or deviations be included within the scope of the followings claims.

What is claimed is:

1. A heater comprising:

a burner for burning a combustible gas to provide hot combustion product gases;

first and second heat transfer pipes each having first and second ends, said first end of said first pipe communicating with said burner for receipt of said gases;

first and second header plates configured for securement to one another, each of said header plates including an aperture, and wherein said second end of said first pipe is coupled to said first header plate such that said first pipe communicates with said aperture extending therethrough and wherein said first end of said second pipe is coupled to said second header plate such that said second pipe communicates with said aperture extending therethrough whereby said pipes fluidly communicate with each other when said header plates are secured together thus allowing said gases to flow from said first pipe to said second pipe; and wherein said first and second header plates are rotatably connected to one another.

2. The heater according to claim 1, further comprising a hinge for rotatably connecting said first and second header plates.

3. The heater according to claim 2, wherein said hinge comprises a piano hinge sized to extend substantially across the width of said header plates.

4. The heater according to claim 1, further comprising a gasket positioned between said header plates and surrounding said apertures for reducing leakage of said gases from said pipes when said header plates are secured together.

5. The heater according to claim 1, further comprising a venting unit communicating with said pipes for exhausting said gases from said pipes.

6. The heater according to claim 5, wherein said venting unit comprises a fan assembly.

7. The heater according to claim 1, further comprising a reflector positioned proximate said pipes for directing radiant heat in a predetermined direction.

8. The heater according to claim 1, further comprising at least one hanger for supporting said heater from an overhead structure.

9. The heater according to claim 1, wherein said header plates further include a plurality of holes sized to receive hardware for securing said header plates to each other.

10. A heater, comprising:

a burner box including a burner for burning a combustible gas to provide hot combustion product gases;

a first outflow pipe and a first return pipe, each of said first pipes having first and second ends, said first end of said first outflow pipe communicating with said burner box for receipt of said product gases and said first end of said first return pipe communicating with said burner box for return of said product gases, said first pipes extending from said burner box in a substantially common direction;

a first header plate, said first header plate including a first outflow pipe aperture and a first return pipe aperture, said first apertures being sized and positioned to communicate with said second ends of said first pipes, and wherein said second end of said first outflow pipe is coupled to said first header plate such that said first outflow pipe communicates with said first outflow pipe aperture and wherein said second end of said first return pipe is coupled to said first header plate such that said first return pipe communicates with said first return pipe aperture;

a second outflow pipe and a second return pipe, each of said second pipes having first and second ends;

a second header plate, said second header plate including a second outflow pipe aperture and a second return pipe aperture, said second apertures being sized and positioned to communicate with said first ends of said second pipes, and wherein said first end of said second outflow pipe is coupled to said second header plate such that said second outflow pipe communicates with said second outflow pipe aperture and wherein said first end of said second return pipe is coupled to said second header plate such that said second return pipe communicates with said second return pipe aperture whereby said second pipes extend from said second header plate in a substantially common direction;

a fluid passage connecting said second end of said second outflow pipe to said second end of said second return pipe; and wherein said first header plate is configured to be coupled to said second header plate whereupon said first outflow pipe is brought into fluid communication with said second outflow pipe and said first return pipe is brought into fluid communication with said second return pipe.

11. The heater according to claim 10, wherein said header plates further include a plurality of holes sized to receive hardware for securing said header plates to each other.

12. The heater according to claim 10, further comprising a hinge for rotatably connecting said first header plate to said second header plate, wherein one side of said hinge is secured to an edge of said first header plate and the other side of said hinge is secured to an edge of said second header plate.

13. The heater according to claim 12, wherein said hinge comprises a piano hinge sized to extend across the width of said header plates.

14. The heater according to claim 10, further comprising at least one gasket positioned between said header plates for reducing leakage of said gases from said pipes.

15. The heater according to claim 10, further comprising first and second gaskets positioned between said header plates for reducing leakage of said gases during operation, said first gasket being located between said second end of said first outflow pipe and said first end of said second outflow pipe and said second gasket being located between said second end of said first return pipe and said first end of said second return pipe.

16. The heater according to claim 10, further comprising a first expansion joint located in fluid communication with said second return pipe to compensate for variations in length of said outflow pipes due to thermal expansion.

17. The heater according to claim 16, wherein said first expansion joint further comprises a tubular collar having an inner diameter $D_1$, said collar being coupled to said second return pipe aperture of said second header plate, and wherein said first end of said second return pipe has an outer diameter $D_2$, and wherein $D_2$ is less than $D_1$ such that said first end of said second return pipe telescopically engages said tubular collar.

18. The heater according to claim 17, further comprising a second expansion joint located in fluid communication with said first return pipe.

19. The heater according to claim 10, wherein said burner box further includes a venting unit in fluid communication with said pipes for exhausting said gases therefrom.

20. The heater according to claim 19, wherein said venting unit includes a fan, and wherein said fan is positioned in fluid communication with said first return pipe.

21. The heater according to claim 10, wherein said fluid passage comprises a turning box.

22. The heater according to claim 10, further comprising third and fourth outflow pipes and third and fourth return pipes, each of said third and fourth pipes having first and second ends, and wherein said third outflow pipe and said third return pipe are located between said burner box and said first header plate and wherein said fourth outflow pipe and said fourth return pipe are located between said second header plate and said fluid passage, and wherein said first end of said third outflow pipe communicates with said burner box for receipt of said gases and wherein said first end of said third return pipe communicates with said burner box for return of said gases.

23. The heater according to claim 22, wherein said fluid passage comprises a turning box, and wherein said turning box communicates with said second ends of said second and fourth outflow pipes and said second ends of said second and fourth return pipes.

24. The heater according to claim 10, further comprising a reflector positioned proximate said pipes for directing radiant heat in a predetermined direction.

25. The heater according to claim 24, wherein said reflector surrounds a portion of the circumference of said pipes and extends substantially along the length of said pipes.

26. The heater according to claim 10, further comprising at least one hanger for supporting said heater from an overhead structure.

27. The heater according to claim 10, further comprising third and fourth header plates, said third header plate including a third outflow pipe aperture and a third return pipe aperture, said third apertures being sized and positioned to communicate with said first ends of said first pipes, and wherein said first end of said first outflow pipe is coupled to said third header plate such that said first outflow pipe communicates with said third outflow pipe aperture and wherein said first end of said first return pipe is coupled to said third header plate such that said first return pipe communicates with said third return pipe aperture; and said fourth header plate including a fourth outflow pipe aperture and a fourth return pipe aperture, said fourth apertures being sized and positioned to communicate with said second ends of said second pipes, and wherein said second end of said second outflow pipe is coupled to said fourth header plate such that said second outflow pipe communicates with said fourth outflow pipe aperture and wherein said second end of said second return pipe is coupled to said fourth header plate such that said second return pipe communicates with said fourth return pipe aperture.

* * * * *